United States Patent [19]

Willis

[11] 4,362,021

[45] Dec. 7, 1982

[54] GAS TURBINE ENGINE FUEL INJECTORS

[75] Inventor: Jeffrey D. Willis, Coventry, England

[73] Assignee: Rolls-Royce Limited, London, England

[21] Appl. No.: 169,430

[22] Filed: Jul. 16, 1980

[30] Foreign Application Priority Data

Aug. 1, 1979 [GB] United Kingdom ..... 7926836

[51] Int. Cl.[3] ..... F23R 3/28; B05B 7/10

[52] U.S. Cl. ..... 60/737; 60/748; 60/749

[58] Field of Search ..... 60/748, 749, 737, 740; 239/400, 405, 406

[56] References Cited

U.S. PATENT DOCUMENTS

| | | | |
|---|---|---|---|
| 2,920,449 | 1/1960 | Johnson et al. | 60/737 |
| 3,690,093 | 9/1972 | Carlisle | 60/742 |
| 3,905,192 | 9/1975 | Pierce et al. | 60/737 |
| 4,198,815 | 4/1980 | Bobo et al. | 60/737 |

FOREIGN PATENT DOCUMENTS

| | | | |
|---|---|---|---|
| 720252 | 3/1980 | U.S.S.R. | 60/737 |

*Primary Examiner*—Robert E. Garrett

*Attorney, Agent, or Firm*—Cushman, Darby & Cushman

[57] ABSTRACT

A gaseous fuel injector for a gas turbine engine, designed to burn gaseous fuels having a wide range of calorific values, includes a fuel nozzle attached to the engine casing and downstream fuel and air inlet means separate from the nozzle, attached to the head of the flame tube. The fuel and air inlet means comprise an outer annular passage containing a row of swirl vanes, through which compressed air from the engine compressor is arranged to flow, and an inner annular passage through which gaseous fuel and compressed air are arranged to flow, the inner annular passage decreasing in cross-sectional area in the direction of flow to prevent the flow of combustion products back into the injector. The nozzle and fuel and air inlet means, which is relatively large, are separate from each other so that the fuel nozzle can be removed and replaced through a relatively small opening in the engine casing.

4 Claims, 2 Drawing Figures

GAS TURBINE ENGINE FUEL INJECTORS

This invention relates to gas turbine engine fuel injectors and is particularly concerned with fuel injectors which can burn gaseous fuels having a wide range of calorific values. For example the calorific value of the gas to be burnt may vary from 100 British Thermal Units/standard cubic foot (BTU/scf) in the case of a coal derived gas having a large proportion of inerts to propane ($C_3H_8$) which has a calorific value of 2316 BTU/scf. In order to maintain a constant heat output/unit time over the whole range of fuels, the fuel injector must be able to cope with a wide range of mass flows. This will require a relatively large flow capacity fuel injector having correspondingly large swirler means and fuel and air inlet means in the flame tube or tubes of the air. With these requirements in mind, the fuel injector must also be readily removable from the in use position through an opening in the engine casing which is not excessively large, and be able to operate without the danger of combustion products from the flame tube or tubes flowing back into the fuel passage of the injector.

The present invention provides a gas turbine engine fuel injector comprising a fuel nozzle and separate downstream fuel and air inlet means including an outer annular passage containing air swirling means and arranged to receive a flow of compressed air and an inner annular passage arranged to receive fuel from the fuel nozzle and a flow of compressed air, the inner annular passage decreasing in cross-sectional area in the direction of flow therethrough.

The fuel nozzle can be removed from the engine separately from the fuel and air inlet means which can be attached to the upstream end of the or each flame tube.

The fuel and air inlet means may comprise inner and outer rings between which a plurality of air swirl vanes are supported to define the outer annular passage, the inner annular passage being defined by a pintle supported centrally within the inner ring.

The outlet of the inner annular passage may be aligned so that fuel and air issuing from the innular annular passage impinges upon the swirling mass of air issuing from the outer annular passage.

The outlet of the fuel nozzle may be smaller in diameter than the outer diameter of the inner annular passage.

Figure 1:
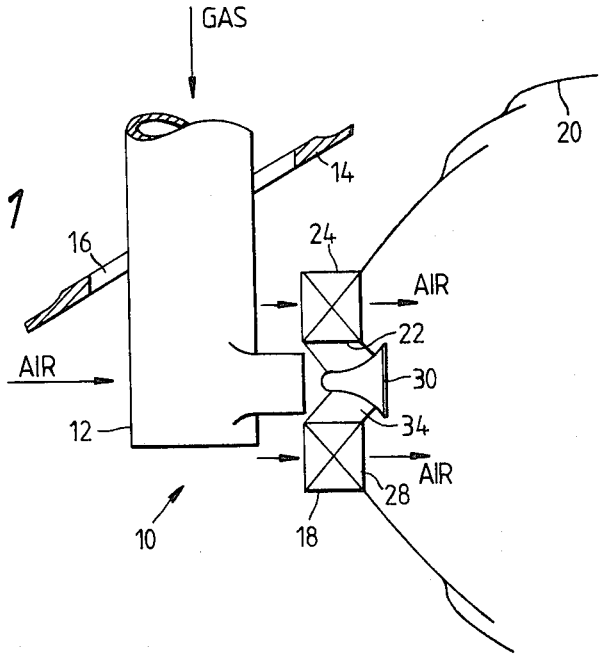
Figure 2:
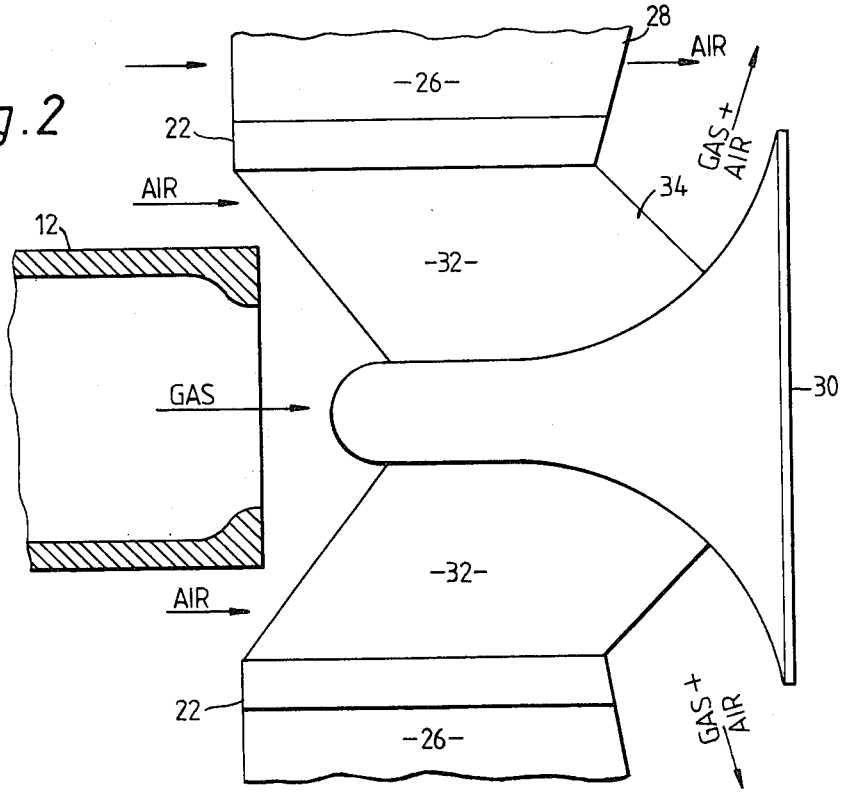

The present invention will now be more particularly described with reference to the accompanying drawing in which;

FIG. 1 is a view of one form of gas turbine engine fuel injector according to the present invention and FIG. 2 is a view to a larger scale of part of the injector shown in FIG. 1

Referring to the drawings, a gas turbine engine fuel injector 10 comprises a gaseous fuel nozzle 12 attached to engine casing 14 and removable through an opening 16 in the casing and a fuel and air inlet means 18 attached to the upstream end of a flame tube 20.

The fuel and air inlet means 18 comprise inner and outer rings 22, 24 respectively, between which are located a plurality of equispaced swirl vanes 26, the inner and outer rings defining an annular passage 28 arranged to receive a flow of compressed air from the compressor of the engine. A pintle 30 is supported centrally in the inner ring 22 by radial arms 32 and with the ring defines an inner annular passage 34 decreases in the direction of flow and so acts as a venturi to prevent the reverse flow of combustion products from the flame tube 20 from entering the passage 34 and nozzle 12.

The outlet of the passage 34 is aligned so that the fuel and air which has already been at least partially mixed in the passage 34 is directed into the swirling mass of air issuing from the passage 28 to promote mixing between the fuel and air and to encourage re-circulation of the fuel and air in the primary zone of the flame tube.

The nozzle 12 being separate from the fuel and air inlet means is readily removable from the in use position through the relatively small opening 16 in the casing 14. If the nozzle and the fuel and air inlet means were an integral assembly an excessively large opening would be required for removal and replacement. Such large openings are undesirable in gas turbine engine casings as they adversely affect the casing strength.

I claim:

1. A gas fuel injector for a gas turbine engine having a casing and a flame tube therein, said gas fuel injector being for use with gaseous fuels having a range of calorific values and comprising:

a fuel nozzle positioned upstream of said flame tube for discharging gaseous fuel in a downstream direction toward said flame tube, said fuel nozzle extending through an opening in and being attached to said casing of said engine; and fuel and air inlet means downstream of said fuel nozzle, said fuel and air inlet means being fixedly attached to the upstream end of said flame tube and separately mounted with respect to said fuel nozzle, said fuel and air inlet means including an outer substantially annular passage containing air swirling means and arranged to receive a flow of compressed air and discharge the same downstream into said flame tube as a flow of swirling air in a direction generally parallel to the longitudinal axis of the flame tube, and an inner substantially annular passage for receiving gaseous fuel from the fuel nozzle and a flow of compressed air, said inner annular passage decreasing in cross-sectional area in a downstream direction and terminating in a downstream outlet aligned to direct the flow of gaseous fuel and compressed air discharged therefrom outwardly at an angle to the longitudinal axis of the flame tube into the flow of swirling air discharging from the outer annular passage.

2. A gas fuel injector as claimed in claim 1 in which the fuel and air inlet means comprise inner and outer rings defining the outer annular passage, and in which said swirling means includes a plurality of equi-spaced swirl vanes located between said rings, and said gas fuel injector further including a pintle supported centrally in said inner ring and defining therewith said inner annular passage decreasing in cross-sectional area in the downstream direction.

3. A fuel injector as claimed in claim 1 or claim 2 in which said fuel nozzle has a diameter less than an outer diameter of said inner annular passage.

4. A fuel injector as claimed in claim 1 or claim 2 in which said downstream outlet of said inner annular passage is substantially annular.

* * * * *